US010279449B2

(12) United States Patent
Xue et al.

(10) Patent No.: US 10,279,449 B2
(45) Date of Patent: May 7, 2019

(54) WHEEL DEBURRING DEIVCE

(71) Applicant: CITIC Dicastal CO., LTD, Qinhuangdao (CN)

(72) Inventors: Bowen Xue, Qinhuangdao (CN); Jiandong Guo, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 22 days.

(21) Appl. No.: 15/392,644

(22) Filed: Dec. 28, 2016

(65) Prior Publication Data

US 2017/0182620 A1 Jun. 29, 2017

(30) Foreign Application Priority Data

Dec. 29, 2015 (CN) ..... 2015 1 1006572

(51) Int. Cl.

| | |
|---|---|
| ***B24B 9/04*** | (2006.01) |
| ***B24B 19/28*** | (2006.01) |
| ***B24B 5/44*** | (2006.01) |
| ***B24B 41/02*** | (2006.01) |
| ***B24B 29/00*** | (2006.01) |
| ***B24B 5/46*** | (2006.01) |

(52) U.S. Cl.

CPC ..... *B24B 9/04* (2013.01); *B24B 5/44* (2013.01); *B24B 5/46* (2013.01); *B24B 19/28* (2013.01); *B24B 29/005* (2013.01); *B24B 41/02* (2013.01)

(58) Field of Classification Search

CPC .... B24B 5/44; B24B 5/46; B24B 9/04; B24B 19/00; B24B 19/28; B24B 29/005; B24B 41/02

USPC ..... 451/294

See application file for complete search history.

(56) References Cited

U.S. PATENT DOCUMENTS

| | | | | |
|---|---|---|---|---|
| 3,258,804 A * | 7/1966 | Fowle | ..... | B24B 5/225 15/104.011 |
| 4,216,560 A * | 8/1980 | Schmidt | ..... | B24B 41/06 15/268 |
| 4,308,630 A * | 1/1982 | Schmidt | ..... | B23Q 11/08 15/104.03 |

(Continued)

FOREIGN PATENT DOCUMENTS

| | | | |
|---|---|---|---|
| CN | 103072057 | * | 5/2013 |
| CN | 203438027 | * | 2/2014 |

(Continued)

*Primary Examiner* — Eileen P Morgan

(74) *Attorney, Agent, or Firm* — Howard IP Law, PLLC; Jeremy Howard

(57) ABSTRACT

A wheel deburring device includes a machine frame, a wheel delivery and positioning mechanism mounted in the frame, and a brush for brushing off burrs from a wheel. The brush is movably mounted to the frame through a rising and falling plate and a sliding plate rack connected with the plate via first guide rails, the brush being able to rotate by a servo motor mounted in the frame and to rise and fall by a rising and falling cylinder. A first servo electric cylinder is mounted so that the first cylinder can adjust angles of the brush. A second servo electric cylinder is fixed at one side of the rising and falling plate, and its output end is connected with the rack so that the second cylinder can adjust positions of the brush through first guide rails.

1 Claim, 4 Drawing Sheets

(56) References Cited

U.S. PATENT DOCUMENTS

| | | | | |
|---|---|---|---|---|
| 6,926,593 | B1 * | 8/2005 | Carroll | B24B 9/04 451/358 |
| 2013/0102233 | A1 * | 4/2013 | Cheon | B24B 27/033 451/331 |
| 2014/0194038 | A1 * | 7/2014 | Lowe | B24B 9/04 451/11 |

FOREIGN PATENT DOCUMENTS

| | | | | |
|---|---|---|---|---|
| JP | 3044289 | B2 | * | 5/2000 |
| JP | 3091417 | B2 | * | 9/2000 |
| KR | 20150062290 | A | * | 6/2015 |

* cited by examiner

WHEEL DEBURRING DEIVCE

This application claims priority from CN 201511006572.1, filed on Dec. 29, 2015, the entire content of which is incorporated herein by reference.

TECHNICAL FIELD

The present invention relates to a deburring device for brushing off burrs of a wheel with a brush, and in particular to an online wheel deburring device.

BACKGROUND ART

In aluminum-alloy wheel production enterprises, deburring is an important link after a machining procedure and directly affects the painting effect of a follow-up painting procedure. At present, a deburring mode for wheel industry is that two large-disc brushes, i.e., an upper large-disc brush and a lower large-disc brush are used for brushing burrs of a back cavity and a front surface of a wheel, in this mode, when angles of the brushes are definite, the lower the linear velocity for brush hairs, the closer the brush central position, so that the problem that the burr processing effect on roots of ring flanges of wheels is poor is directly caused. Edge brush hairs of the traditional large-disc brushes are hardly made into shapes which are completely consistent with those of rim corners of the wheels, so that the problem that the burr processing effect on the rim corners often does not meet the ideal requirements is caused. At the above two positions, a great deal of labor is required to be input so as to carry out manual grinding, the efficiency is low, the cost is high, and the effect is non-uniform, so that the wheel deburring device is used for carrying out focused processing on burrs of root corners of flanges, thus, the labor intensity for grinders is lowered, and the production efficiency is increased.

SUMMARY OF THE INVENTION

An object of the present invention is to provide a wheel deburring device which can be used for carrying out focused processing on burrs of root corners of flanges and burrs of root corners of rims of wheels.

In order to achieve the object described above, a technical solution of the present invention is as follows: a wheel deburring device is composed of a machine frame, a bottom plate, guide sleeves, guide posts, a rising and falling plate, first guide rails, a sliding plate rack, a lead screw, a nut, a left sliding table, lifting cylinders, lifting plates, first bearing blocks, first shafts, V-type rollers, a right sliding table, a drive motor, first belt pulleys, a first synchronizing belt, a second belt pulley, a third belt pulley, a second synchronizing belt, a pneumatic motor, a fourth belt pulley, rising and falling cylinders, a second guide rail, a sliding block, a first servo electric cylinder, a second servo electric cylinder, a link, a fifth belt pulley, a swinging plate, a third synchronizing belt, a brush, a sixth belt pulley, a second bearing block, a third servo motor, guide rails, cushion blocks, conveying roller ways, a conveying motor and a second shaft. The four guide posts are fixed between the bottom plate and a top plate of the machine frame. The four guide sleeves matched with the guide posts are fixed on the rising and falling plate. The two rising and falling cylinders are also fixed on the bottom plate, and output ends of the two rising and falling cylinders are hinged to the rising and falling plate. The sliding plate rack is connected with the rising and falling plate through the first guide rails.

The left sliding table and the right sliding table are connected with the top plate of the machine frame through the third guide rails and the cushion blocks. The third belt pulley is mounted at an output end of the lead screw matched with the nut, the pneumatic motor, of which an output end is provided with the fourth belt pulley, is fixed on the bottom plate, and the third belt pulley and the fourth belt pulley are connected through the second synchronizing belt. Two first bearing blocks are fixed above each of the left sliding table and the right sliding table, and the four first shafts, of which upper ends are separately fixedly provided with the V-type rollers, are separately mounted in the four first bearing blocks through bearings. The first belt pulleys are separately mounted at lower ends of the two first shafts fixed on the right sliding table. The drive motor, of which an output end is provided with the second belt pulley, is fixed at the right side of the right sliding table. The first belt pulleys and the second belt pulley are connected through the first synchronizing belt. The lifting cylinders, of which output ends are separately fixedly provided with the lifting plates, are fixed at two ends of the top plate of the machine frame.

The second servo electric cylinder is fixed at one side of the rising and falling plate, and an output end of the second servo electric cylinder is connected with the sliding plate rack. The sliding block is fixed above the sliding plate rack through the second guide rail. The first servo electric cylinder is mounted at the left side of the sliding plate rack, and an output end of the first servo electric cylinder is connected with the sliding block. The swinging plate is hinged above the sliding plate rack. The servo motor, of which an output end is fixedly provided with the fifth belt pulley, is fixed below the swinging plate. The second bearing block is mounted above the swinging plate. The second shaft which is simultaneously fixedly provided with the brush and the sixth belt pulley is mounted inside the bearing block through a bearing. The fifth belt pulley and the sixth belt pulley are connected through the third synchronizing belt. The link is hinged between the sliding block and the swinging plate.

The two conveying roller ways are fixed above a platform of the machine frame and are arranged between the left sliding table and the right sliding table. The conveying motor mounted on the bottom plate is used for driving the two conveying roller ways.

During actual use, the conveying roller ways enable a wheel to reach approximate middle positions of the four V-type rollers, the wheel is lifted by the lifting cylinders, the pneumatic motor drives the lead screw to rotate so as to enable the left sliding table and the right sliding table to drive the four V-type rollers to synchronously clamp the wheel, and the drive motor is used for achieving the rotation of the wheel in a clamped state. The servo motor drives the brush to rotate, the rising and falling cylinders lift the brush through the four guide posts, certain pressure is applied to the brush when the brush is in contact with flange corners of the wheel, then, the brush starts to remove burrs from the flange corners of the wheel, the first servo electric cylinder is used for achieving angle adjustment on the brush, and the second servo electric cylinder is used for achieving position adjustment on the brush through the first guide rails. When the brush is adjusted to an appropriate angle, the burr removal of rim corners can be completed, and thus the wheel deburring device can adapt to wheels of any model.

When in use, the wheel deburring device can be used for carrying out focused processing on the burrs of the root corners of the flanges and the burrs of the root corners of the rims of the wheels, so that the problem of the traditional large-disc brushes that the burr processing effect on flange corner positions is poor due to the fact that the linear velocity of a position close to a central position is low when an angular velocity is definite is completely avoided. The problem of the traditional large-disc brushes that the burr processing effect on wheel rim corner positions is poor due to the fact that edge brush hairs of the traditional large-disc brushes are hardly made into shapes which are completely consistent with those of rim corners of wheels is also avoided. At the same time, the wheel deburring device has the characteristics of simple structure, high degree of automation, advanced technology, high universality, high efficiency and safe and stable performance.

Figure 1:
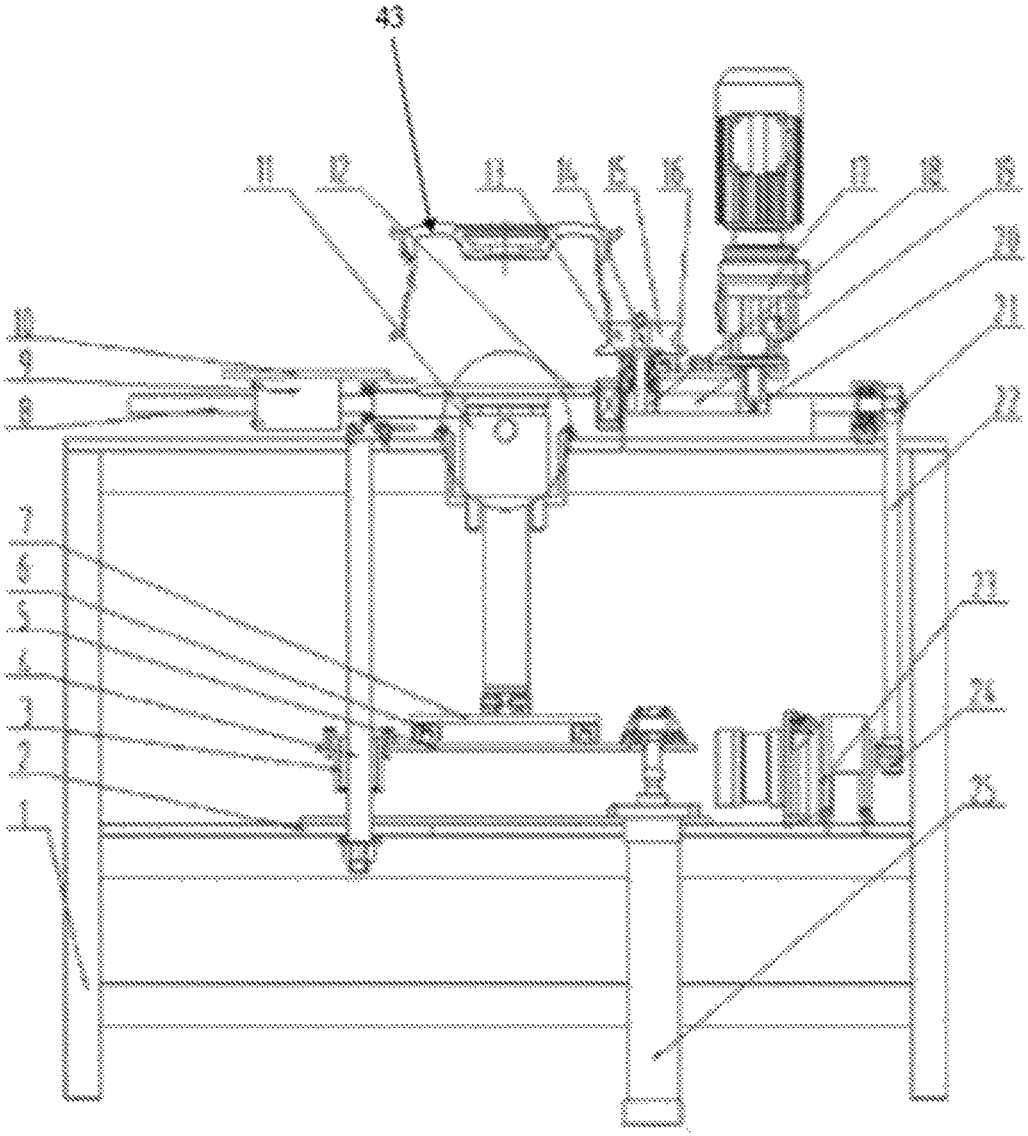
FIG. 1 is a front view of a wheel deburring device provided by the present invention.
Figure 2:
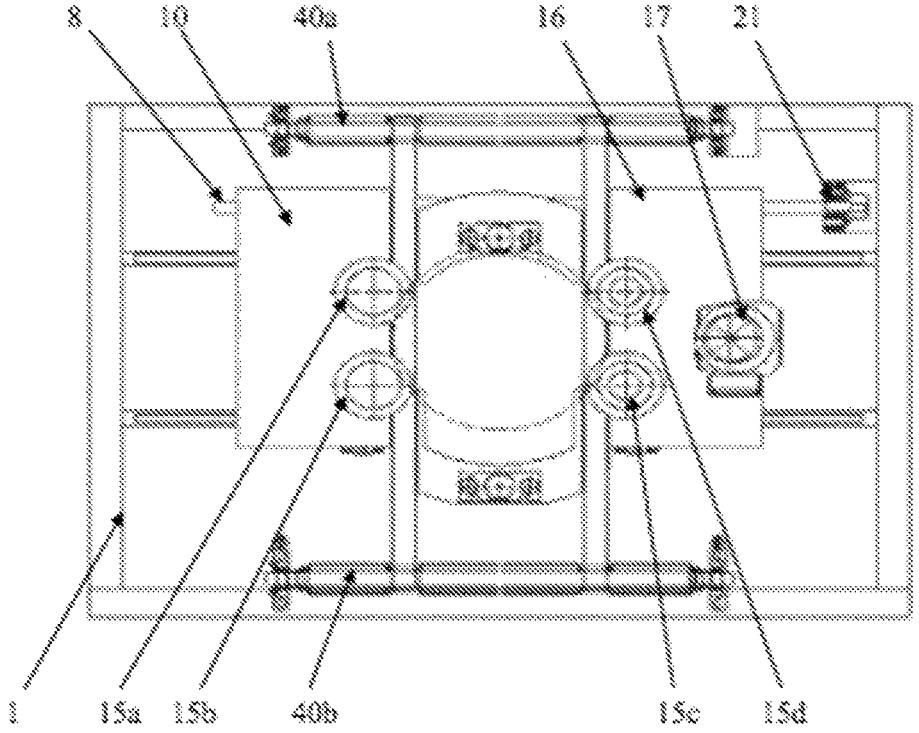
FIG. 2 is a top view of a wheel deburring device provided by the present invention.
Figure 3:
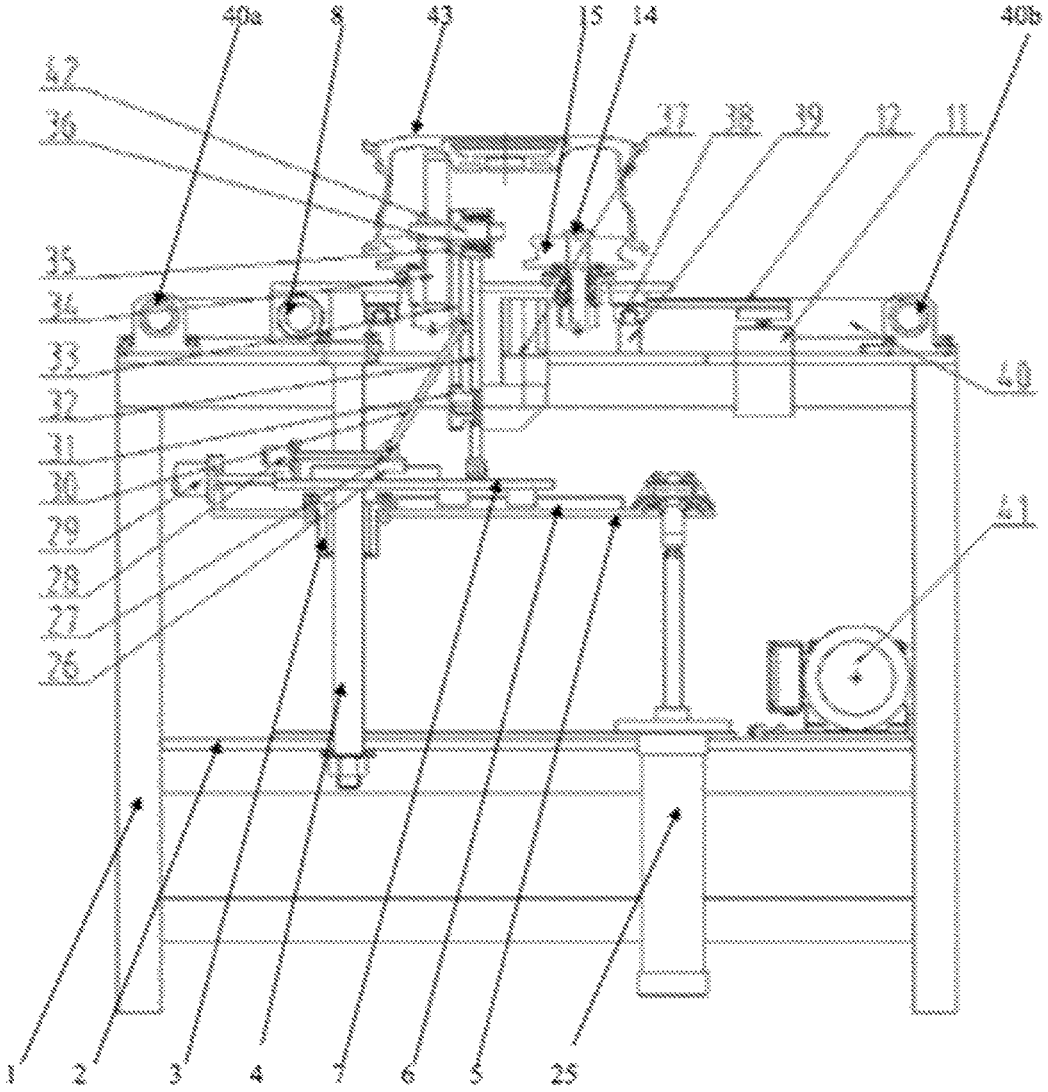
FIG. 3 is a left view of a wheel deburring device provided by the present invention during brushing of burrs of root corners of flanges.
Figure 4:
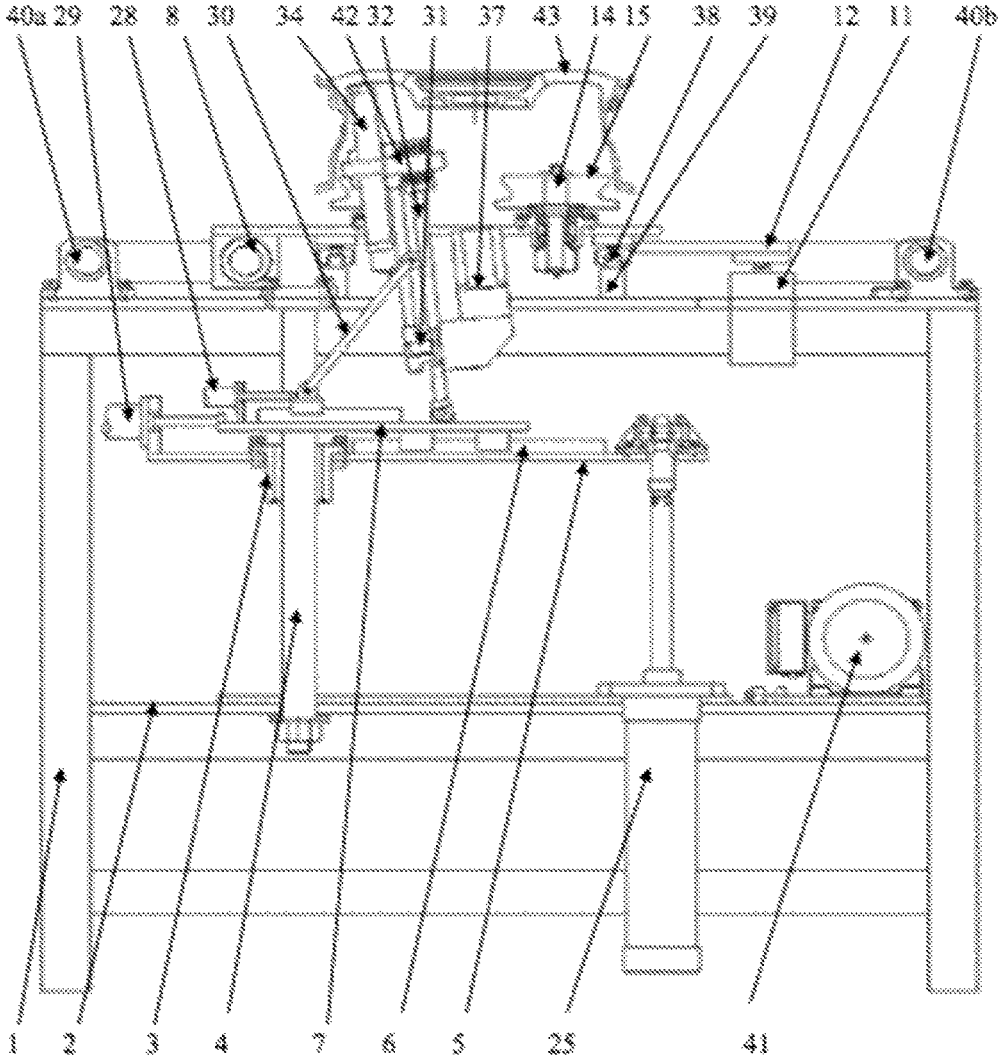
FIG. 4 is a left view of a wheel deburring device provided by the present invention during brushing of burrs of root corners of rims.

In the figures, numeric symbols are as follows: 1—machine frame, 2—bottom plate, 3—guide sleeve, 4—guide post, 5—rising and falling plate, 6—first guide rail, 7—sliding plate rack, 8—lead screw, 9—nut, 10—left sliding table, 11—lifting cylinder, 12—lifting plate, 13—first bearing block, 14—first shaft, 15—V-type roller, 16—right sliding table, 17—drive motor, 18—first belt pulley, 19—first synchronizing belt, 20—second belt pulley, 21—third belt pulley, 22—second synchronizing belt, 23—pneumatic motor, 24—fourth belt pulley, 25—rising and falling cylinder, 26—second guide rail, 27—sliding block, 28—first servo electric cylinder, 29—second servo electric cylinder, 30—link, 31—fifth belt pulley, 32—swinging plate, 33—third synchronizing belt, 34—brush, 35—sixth belt pulley, 36—second bearing block, 37—servo motor, 38—third guide rail, 39—cushion block, 40—conveying roller way, 41—conveying motor and 42—second shaft.

DETAILED DESCRIPTION OF THE INVENTION

In the following, the details and working conditions of a specific device provided by the present invention are described in combination with the figures.

A wheel deburring device, comprising a machine frame (1), a wheel delivery and positioning mechanism mounted in the machine frame (1), and a brush (34) for brushing off burrs from a wheel 43, wherein the brush (34) is movably mounted to the machine frame (1) through a lifting plate (5) and a sliding plate rack (7) connected with the lifting plate (5) via first guide rails (6), the brush (34) being able to rotate by a servo motor (37) mounted in the machine frame (1) and to rise and fall by a cylinder (25) which can raise the lifting plate (5) in order to raise the brush (34) to contact flange corners of the wheel (43) and also to press the brush (34) against surface of flange corners of the wheel (43) when the brush (34) is in contact with the flange corners of the wheel (43) so that the brush (34) can apply an abrasive force on surface of the flange corners of the wheel (43) to remove burrs from the flange corners of the wheel (43), wherein a first servo electric cylinder (28) is mounted at a left side of the sliding plate rack (7) and an output end of the first servo electric cylinder (28) is connected with a sliding block (27), the sliding block (27) being fixed above the sliding plate rack (7) through a second guide rail (26) so that the first servo electric cylinder 28 can adjust angles of the brush (34) via the link (30), and wherein a second servo electric cylinder (29) is fixed at one side of the lifting plate (5), and an output end of the second servo electric cylinder (29) is connected with the sliding plate rack (7) so that the second servo electric cylinder (29) can adjust positions of the brush (34) through the first guide rails (6).

The wheel deburring device is composed of a machine frame 1, a bottom plate 2, guide sleeves 3, guide posts 4, a lifting plate 5, guide rails I 6, a sliding plate rack 7, a lead screw 8, a nut 9, a left sliding table 10, lifting cylinders 11, lifting plates 12, first bearing blocks 13, first shafts 14, V-type rollers 15, a right sliding table 16, a drive motor 17, belt pulleys 18, a first synchronizing belt 19, a second belt pulley 20, a third belt pulley 21, a second synchronizing belt 22, a pneumatic motor 23, a fourth belt pulley 24, cylinders 25, a second guide rail 26, a sliding block 27, a first servo electric cylinder 28, a second servo electric cylinder 29, a link 30, a fifth belt pulley 31, a swinging plate 32, a third synchronizing belt 33, a brush 34, a sixth belt pulley 35, a second bearing block 36, a servo motor 37, third guide rails 38, cushion blocks 39, conveying roller ways 40, a conveying motor 41 and a second shaft 42. The four guide posts 4 are fixed between the bottom plate 2 and a top plate of the machine frame 1. The four guide sleeves 3 matched with the guide posts 4 are fixed on the rising and falling plate 5. The two cylinders 25 are also fixed on the bottom plate 2, and output ends of the two cylinders 25 are hinged to the lifting plate 5. The sliding plate rack 7 is connected with the lifting plate 5 through the guide rails I 6.

The left sliding table 10 and the right sliding table 16 are connected with the top plate of the machine frame 1 through the third guide rails 38 and the cushion blocks 39. The third belt pulley 21 is mounted at an output end of the lead screw 8 matched with the nut 9, the pneumatic motor 23, of which an output end is provided with the fourth belt pulley 24, is fixed on the bottom plate 2, and the third belt pulley 21 and the fourth belt pulley 24 are connected through the second synchronizing belt 22. Two first bearing blocks 13 are fixed above each of the left sliding table 10 and the right sliding table 16, and the four shafts I 14, of which upper ends are separately fixedly provided with the V-type rollers 15 (15*a*, 15*b*, 15*c*, and 15*d*), are separately mounted in the four first bearing blocks 13 through bearings. The first belt pulleys 18 are separately mounted at lower ends of the two first shafts 14 fixed on the right sliding table 16. The drive motor 17, of which an output end is provided with the second belt pulley 20, is fixed at the right side of the right sliding table 16. The first belt pulleys 18 and the second belt pulley 20 are connected through the first synchronizing belt 19. The lifting cylinders 11, of which output ends are separately fixedly provided with the lifting plates 12, are fixed at two ends of the top plate of the machine frame 1.

The second servo electric cylinder 29 is fixed at one side of the lifting plate 5, and an output end of the second servo electric cylinder 29 is connected with the sliding plate rack 7. The sliding block 27 is fixed above the sliding plate rack 7 through the second guide rail 26. The first servo electric cylinder 28 is mounted at the left side of the sliding plate rack 7, and an output end of the first servo electric cylinder 28 is connected with the sliding block 27. The swinging plate 32 is hinged above the sliding plate rack 7. The servo motor 37, of which an output end is fixedly provided with the fifth belt pulley 31, is fixed below the swinging plate 32.

The second bearing block 36 is mounted above the swinging plate 32. The second shaft 42 which is simultaneously fixedly provided with the brush 34 and the belt pulley 35 is mounted inside the second bearing block 36 through a bearing. The fifth belt pulley 31 and the sixth belt pulley 35 are connected through the third synchronizing belt 33. The link 30 is hinged between the sliding block 27 and the swinging plate 32.

The two conveying roller ways 40 (40*a*, 40*b*) are fixed above a platform of the machine frame 1 and are arranged between the left sliding table 10 and the right sliding table 16. The conveying motor 41 mounted on the bottom plate 2 is used for driving the two conveying roller ways 40 (40*a*, 40*b*).

During work, the conveying roller ways 40 enable a wheel to reach approximate middle positions of the four V-type rollers 15, the wheel is lifted by the lifting cylinders 25, the pneumatic motor 23 drives the lead screw 8 to rotate so as to enable the left sliding table 10 and the right sliding table 16 to drive the four V-type rollers 15 to synchronously clamp the wheel, and the drive motor 17 is used for achieving the rotation of the wheel in a clamped state. The servo motor 37 drives the brush 34 to rotate, the rising and falling cylinders 25 lift the brush 34 through the four guide posts 4, certain pressure is applied to the brush 34 when the brush 34 is in contact with flange corners of the wheel, then, the brush 34 starts to remove burrs from the flange corners of the wheel, the servo electric cylinder 28 is used for achieving angle adjustment on the brush 34, and the second servo electric cylinder 29 is used for achieving position adjustment on the brush 34 through the guide rails 6. When the brush 34 is adjusted to an appropriate angle, the burr removal of rim corners can be completed, and thus the wheel deburring device can adapt to wheels of any model.

What is claimed is:

1. A wheel deburring device, comprising: a machine frame (1), a wheel delivery and positioning mechanism mounted in the machine frame (1), and a brush (34) for brushing off burrs from a wheel (43), wherein the brush (34) is movably mounted to the machine frame (1) through a lifting plate (5) and a sliding plate rack (7) connected with the lifting plate (5) via first guide rails (6), the brush (34) being able to rotate by a servo motor (37) mounted in the machine frame (1) and to rise and fall by a cylinder (25) which can raise the lifting plate (5) in order to raise the brush (34) to contact flange corners of the wheel (43) and also to press the brush (34) against surface of flange corners of the wheel (43) when the brush (34) is in contact with the flange corners of the wheel (43) so that the brush (34) can apply an abrasive force on surface of the flange corners of the wheel (43) to remove burrs from the flange corners of the wheel (43), wherein a first servo electric cylinder (28) is mounted at a side of the sliding plate rack (7) and an output end of the first servo electric cylinder (28) is connected with a sliding block (27), the sliding block (27) being fixed above the sliding plate rack (7) through a second guide rail (26) so that the first servo electric cylinder 28 can adjust angles of the brush (34) via a link (30), and wherein a second servo electric cylinder (29) is fixed at one side of the rising and falling plate (5), and an output end of the second servo electric cylinder (29) is connected with the sliding plate rack (7) so that the second servo electric cylinder (29) can adjust positions of the brush (34) through the first guide rails (6).

* * * * *